US006038991A

United States Patent [19]

Nelson

[11] Patent Number: 6,038,991

[45] Date of Patent: Mar. 21, 2000

[54] SEAT FOR USE ON AN INNER TUBE

[76] Inventor: Ricky F. Nelson, 17511 Compass Rose Cir., Crosby, Tex. 77532-4210

[21] Appl. No.: 09/280,935

[22] Filed: Mar. 29, 1999

[51] Int. Cl.[7] ..... B63B 3/38

[52] U.S. Cl. ..... 114/131; 114/345

[58] Field of Search ..... 114/345, 346, 114/363, 352–354; 441/129–131, 65, 66

[56] References Cited

U.S. PATENT DOCUMENTS 5,123,702 6/1992 Caruso ..... 297/342
5,224,891 7/1993 Stephens ..... 441/130

*Primary Examiner*—Ed Swinehart
*Attorney, Agent, or Firm*—Harrison & Egbert

[57] ABSTRACT

A seat for use on an inner tube having a body with a channel formed therearound of a size suitable for receiving an exterior surface of an inner tube therein and a seat formed in a central area of said body. The seat has a back portion extending upwardly above the body at one end of the body. The body and the seat are integrally formed together of a polymeric material. The body has a generally rectangular configuration. The back of the seat extends at approximately thirty degree angle relative to a bottom of the body. The seat has a bottom extending for at least two inches below the bottom of the body.

15 Claims, 2 Drawing Sheets

SEAT FOR USE ON AN INNER TUBE

TECHNICAL FIELD

The present invention relates to floating devices made of inner tubes. More particularly, the present invention relates to devices that can be applied to an exterior surface of an inner tube so as to facilitate the ability to sit within the inner tube. More particularly, the present invention relates to seats which are adapted for attachment to the exterior surface of inner tubes.

BACKGROUND ART

The sport of "tubing" has gained increasing popularity in recent years. An automotive inner tube is used as a floating seat to support a person in water. Normally, the person will place legs, arms and upper back over the top of the tube, and permit the lower back and bottom to protrude through the tube into the water. When the body of water is a river, particularly one with small rapids, an exhilarating and enjoyable experience can be had.

Inner tubes are the chosen device for tubing for a number of reasons including their availability and their minimal cost. Floating on a body of water without using an inner tube cannot properly be called "tubing". As a consequence, the equipment used for tubing has remained fairly constant over the years, rarely comprising anything beyond an inner tube.

In the past, various U.S. patents have issued on devices for attachment to inner tubes or for facilitating the ability to carry out the activity of "tubing". U.S. Pat. No. 4,101,996, issued on Jul. 25, 1978, to Mikulecky describe a foot-propelled water vehicle including a hard-shelled body having a generally annular periphery. The body has a seat cavity integrally formed with the body such that an individual may recline within the seat so that the individual's legs extend over a side. By kicking, the individual may propel the vehicle.

U.S. Pat. No. 4,160,299, issued on Jul. 10, 1979 to T. Hilbern, describes an inner tube seat for attachment to an inflated inner tube for the purpose of supporting a user above a water surface while enabling him to use his feet and legs for propulsion. The seat is comprised of a semi-rigid elongated seat member formed with integral arcuate ends that conform to the configuration of an inflated inner tube section. The seat member extends across the full diameter of the tube but does not span the entire central opening of the tube, thereby leaving a crescent-shaped opening for access by the user's legs. The seat member also includes forward and rearward side edges.

U.S. Pat. No. 4,601,667, issued on Jul. 22, 1986 to D. H. Hull, describes a gas-inflatable floatable portable seat that is especially adapted for supporting a child, or other person, in a seating position. The seat is adapted to be attached to a boat or other vehicle or to be independently floatable on the water. The seat comprises a first generally annular-shaped lower inflatable float chamber fabricated from flexible sheet material defining a lower leg compartment for a person and adapted to provide needed buoyancy when placed in the water. A second, generally annular-shaped, upper inflatable float chamber is secured on top of the first chamber and is formed with an open segment on a back side thereof to provide armrests on opposite sides of the open segment. An inflatable seat structure comprises an upstanding back projecting upwardly of the second float chamber and a generally upstanding outer back face and a seat cushion projecting inwardly of the back into the leg compartment through the open segment of the second float chamber. U.S. Pat. No. 4,687,452, issued to the same inventor, describes a similar configuration.

U.S. Pat. No. 5,224,891, issued on Jul. 6, 1993 to W. C. Stephens, teaches an insert for an inflatable buoyant toroid having a bottom portion with one or more contoured, concave surfaces radially disposed about a circular base and one or more seating portions above the bottom portion. The center of gravity of the insert is on a vertical axis passing substantially through the center of the circular base whether the insert contains a passenger or not. A floatation device comprising the insert and an inflatable buoyant toroid has positive stability in the water. The center of gravity of the insert is adjusted by a ballasting apparatus.

The major problem associated with these prior art devices is a relatively high center of gravity relative to the inner tube. In many cases, the attachment of an apparatus to the exterior surface of an inner tube will create high center of gravities which can result in unstable operation. It is undesirable to have the inner tube capsize within the water. Greater stability and floatability of the inner tube is achieved by having a lower center of gravity. Whenever the center of gravity is in a vertical orientation, instability will inherently result. As such, there is a need to design the seat for use with an inner tube having a relatively horizontal center of gravity for improved stability. Additionally, these prior art devices are often difficult to install onto the surface of an inner tube. The round configuration of such devices causes a "spinning" action, in conjunction with the inner tube, rather than a hydrodynamic configuration. Additionally, these devices are often configured to receive only a certain type of inner tube rather than a wide variety of sizes of inner tubes.

It is an object of the present invention to provide a seat for an inner tube which maintains a low center of gravity.

It is another object of the present invention to provide a seat for an inner tube which is easy to install on inner tubes of multiple sizes.

It is a further object of the present invention to provide a seat for an inner tube which has improved hydrodynamic characteristics.

It is still a further object of the present invention to provide a seat for use on an inner tube which allows for the attachment of exterior items, such as cans.

It is still another object of the present invention to provide a seat for an inner tube which is relatively easy to use, inexpensive, and easy to manufacture.

These and other objects and advantages of the present invention will become apparent from a reading of the attached specification and appended claims.

SUMMARY OF THE INVENTION

The present invention is a seat for use on an inner tube comprising a body having a channel formed therearound having a size suitable for receiving an exterior surface of the inner tube and a seat formed in a central area of the body. The seat has a back portion extending upwardly above the body at one end of the body. The body and the seat are integrally formed together of a polymeric material.

The body has a generally rectangular configuration. The back portion of the seat extends at an approximately thirty degree (30°) angle relative to the bottom of the body. The seat has a bottom extending below the bottom of the body for at least two inches. The seat has a ribbed exterior surface. The seat also has a pair of arms extending outwardly from a back surface of the seat on opposite sides of the seat. The back portion of the seat extends upwardly for less than one foot from a bottom of the body.

The body has a receptacle formed on an opposite end of the body which extends downwardly from a top surface of the body. This receptacle is suitable for the receipt of cans and other containers therein. Additionally, the body has an indentation formed on opposite sides of the central area suitable for action as handgrips. The body has sides extending downwardly from a top surface of the body for less than the thickness of the inner tube. The channel of the body is suitable for placement on the exterior surface of the inner tube.

DETAILED DESCRIPTION OF THE INVENTION

Figure 1:
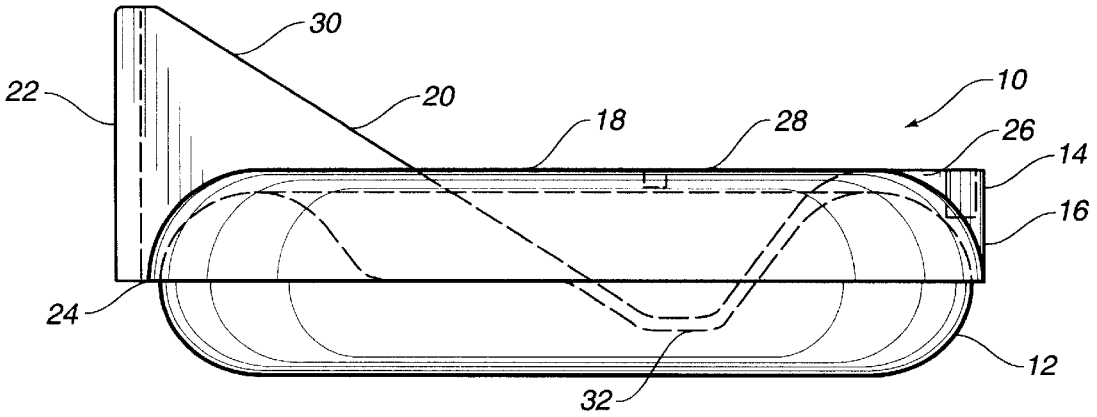
FIG. 1 is a side elevational view of the seat of the present invention as attached to an inner tube.

Referring to FIG. 1, there is shown at 10 the apparatus in accordance with the teachings of the present invention. Apparatus 10 is shown as placed upon the surface of an inner tube 12. As can be seen in FIG. 1, the apparatus 10 includes a body 14 having a channel area 16 formed therearound. The channel area 16 has a size suitable for receiving the exterior surface of the inner tube 12 therein. The body 14 has a central area 18. A seat 20 is formed in the central area 18 of the body 14. The seat 20 has a back portion 22 extending upwardly above the body at one end of the body 14. The body 14 and the seat 20 are integrally formed together of a polymeric material.

As can be seen in FIG. 1, the body 14 has a bottom edge 24 which extends over a portion of the top curved surface of the inner tube 12. The bottom edge 24 is aligned in a horizontal orientation approximately midway of the thickness of the inner tube 12. The extent to which the bottom edge 24 extends downwardly over the surface of the inner tube 12 will depend, of course, on the size and thickness of the inner tube 12. Conventionally, the body 14 has sides 26 which extend downwardly from the top surface 28 toward the bottom edge 24. The top surface 28 is oriented in a horizontal orientation. The sides 26 have, in the preferred embodiment of the present invention, a width of no less than six inches.

In FIG. 1, it can be seen that the inner tube 12 has a generally toroidal configuration. As such, the seat 20 and the central area 18 will fit within the open center of the inner tube 12. A cross-sectional diameter of the inner tube 12 will fit within the channel 16 extending around the body 14. In order to maintain a low center of gravity of the body 14, the seat 20 will have a surface 30 extending at approximately thirty degree (30°) angle relative to the bottom edge 24 of the body 14. The seat 20 has a bottom 32 which will extend below the bottom edge 24 of the body 14. In the preferred embodiment of the present invention, this bottom 32 will extend for at least two inches below the bottom edge 24 of the body 14. The thirty degree (30°) angle of the surface 30 will assure a relatively horizontal center of gravity when the user is actually sitting within the inner tube. In normal use, the buttocks of the user will reside within the bottom 32 of the seat 20. The shoulders and head of the user will reside against surface 30. The legs of the user will extend over the top surface 24 at the forward end of the body 14. This low center of gravity will maintain stability while the inner tube 12 is placed in a moving body of water.

The back surface 22 of the seat 20 extends upwardly for less than a foot from the bottom edge 24.

Figure 2:
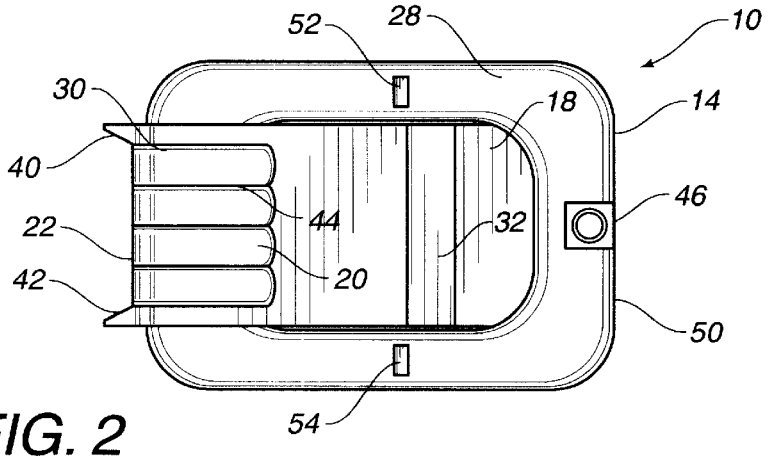
FIG. 2 is a plan view of the seat of the present invention.

In FIG. 2, it can be seen that the body 14 has a generally rectangular configuration. Experiments with the present invention have shown that the rectangular configuration of the body 14 creates a better, more hydrodynamic configuration. The inner tube, although toroidal in shape, can conform to the rectangular shape of the body 14. A simple deflation of the inner tube will allow the inner tube to fit within the rectangular channel extending around the body 14. The seat 20 is illustrated as extending into the central area 18 of the body 14. A pair of arms 40 and 42 extend outwardly from opposite sides of the back portion 22 of the back surface 30. It can be seen that the back surface 30 has a plurality of ribs 44 extending longitudinally therealong. These ribs will facilitate proper traction between the back of the user and the surface 30 of the seat 20. The bottom 32 resides within the central portion 18 of the body 14.

In FIG. 2, it can be seen that a receptacle 46 is formed on an end of the body 14 opposite the back portion 22. Receptacle 46 will extend downwardly from the top surface 28 of the body 14. Receptacle 46 is suitably configured for the receipt of a container or a can therein. The location of the receptacle 46 in the forward portion of the body 14 facilitates access to the receptacle 46 by the user. Indentations 52 and 54 are formed in the top surface 28 on opposite sides of the central area 18. The indentations 52 and 54 serve as handgrips by the user. These handgrips 52 and 54 facilitate the "steerability" of the apparatus 10 when in turbulent water.

Figure 3:
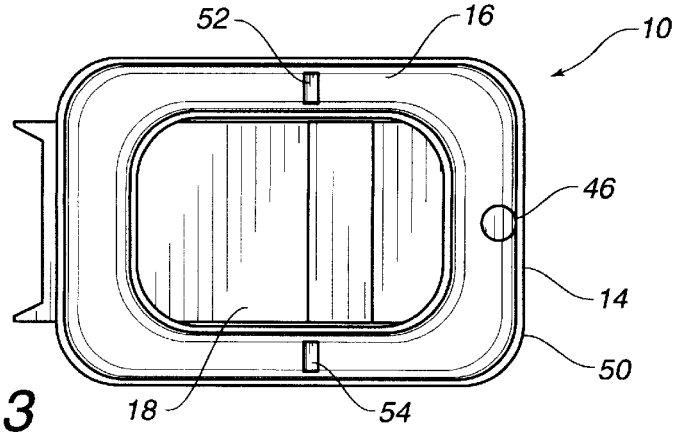
FIG. 3 is a bottom view of the seat of the present invention.

FIG. 3 shows a bottom view of the apparatus 10 of the present invention. In FIG. 3, it can be seen that the channel 16 extends around the interior of the body 14. Channel 16 will have a size suitable for the receipt of the exterior surface of the inner tube therein. Receptacle 46 is located just behind the forward edge 50. Indentations 52 and 54 are illustrated as located on opposite sides of the central area 18.

Figure 4:
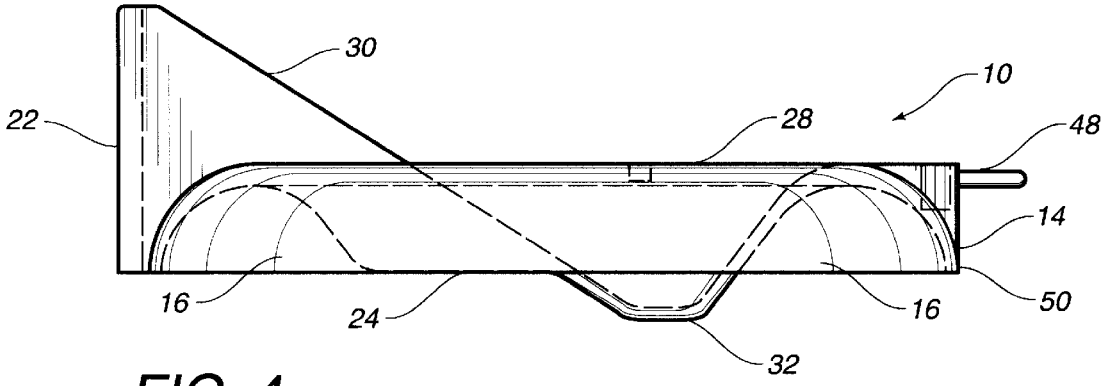
FIG. 4 is an isolated side elevational view of the seat of the present invention.

FIG. 4 is an isolated view of the apparatus 10 as separated from the inner tube 12. As can be seen, the body 14 has bottom edge 24 and top edge 28. The back portion 22 will extend upwardly in a vertical orientation relative to the bottom edge 24. In the preferred embodiment of the present invention, the back portion 22 will extend upwardly for no more than one foot. This low profile will assure the stability of the floating inner tube. The back surface 30 extends at an approximately thirty degree (30°) angle with respect to the bottom edge 24. It can be seen that the bottom 32 extends below the bottom edge 24. The channel 16 serves to receive the outer surface of the inner tube therein.

Figure 5:
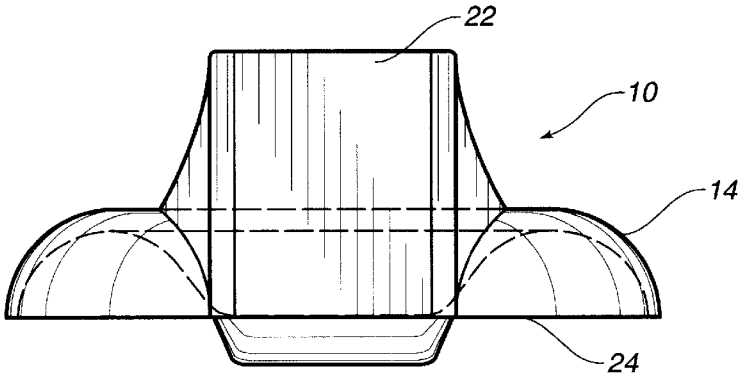
FIG. 5 is a back view of the seat of the present invention.

FIG. 5 shows the back view of the apparatus 10. It can be seen that the back portion 22 extends vertically upwardly from the bottom surface 24. The body 14 has sides which extend outwardly from the back portion 22.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An apparatus for use on an inner tube comprising:

a body having a channel formed therearound, said channel having a size suitable for receiving an exterior surface of the inner tube; and a seat formed centrally of said body, said seat having a back portion extending upwardly above said channel at one end of said body, said body and said seat being integrally formed together of a polymeric material, said back portion of said seat extending at an approximately thirty degree angle relative to a bottom of said body, said seat having a bottom extending below said bottom of said body.

2. The apparatus of claim 1, said body having a generally rectangular configuration.

3. The apparatus of claim 1, said bottom of said seat extending for at least two inches below said bottom of said body.

4. The apparatus of claim 1, said seat having a ribbed exterior surface.

5. The apparatus of claim 1, said seat having a pair of arms extending outwardly from a back surface of said seat on opposite sides of said seat.

6. The apparatus of claim 1, said back portion of said seat extending upwardly for less than one foot from said bottom of said body, said bottom of said seat extending downwardly for at least two inches from said bottom of said body.

7. The apparatus of claim 1, said body having a receptacle formed at an opposite end of said body, said receptacle extending downwardly from a top surface of said body.

8. The apparatus of claim 1, said body having indentations formed thereon on opposite sides of said seat.

9. The apparatus of claim 1, said polymeric material being polyethylene having a thickness of less than one-quarter inch.

10. The apparatus of claim 1, said body having sides extending downwardly from a top surface of said body, said sides extending downwardly for no more than six inches.

11. An apparatus comprising:

an inner tube of a generally annular configuration;

a body affixed to a surface of said inner tube; and a seat formed centrally of said body, said seat having a bottom extending downwardly into a central area of said inner tube, said seat having a back portion extending upwardly from said bottom at one end of said body, said back portion extending above said inner tube, said back portion of said seat extending at an approximately thirty degree angle relative to a bottom of said body, said bottom of said seat extending at least two inches below said bottom of said body.

12. The apparatus of claim 11, said body having sides extending downwardly over a portion of an outer surface of said inner tube, said inner tube being retained interior of said sides.

13. The apparatus of claim 11, said body having a bottom edge positioned above a bottom of said inner tube.

14. The apparatus of claim 11, said body having a generally rectangular configuration.

15. The apparatus of claim 11, said body being removably attached to said inner tube.

* * * * *